United States Patent [19]

Baringer

[11] 4,068,519

[45] Jan. 17, 1978

[54] UNLOADER FOR PRESS

[75] Inventor: B. E. Baringer, West Bloomfield, Mich.

[73] Assignee: Kasle Steel Corporation, Detroit, Mich.

[21] Appl. No.: 646,125

[22] Filed: Jan. 5, 1976

[51] Int. Cl.[2] ..... B21D 45/04; B26D 7/18

[52] U.S. Cl. ..... 72/426; 83/81; 83/160

[58] Field of Search ..... 72/426, 427, 418; 83/81, 158, 160

[56] References Cited

U.S. PATENT DOCUMENTS

| | | | |
|---|---|---|---|
| 3,057,312 | 10/1962 | Hatch | 72/426 |
| 3,148,571 | 9/1964 | Wallis | 83/160 X |
| 3,349,602 | 10/1967 | Nelson | 72/426 |
| 3,855,840 | 12/1974 | Kawano | 72/418 |

*Primary Examiner*—C.W. Lanham
*Assistant Examiner*—D. M. Gurley
*Attorney, Agent, or Firm*—Cullen, Settle, Sloman & Cantor

[57] ABSTRACT

An unloader for a conventional press of the type having a reciprocable ram, the unloader including a drive rack positively reciprocated by the ram to drive the unloader in synchronization with press movement, a stationary support frame extending into the die area, and a tray movably mounted on the support frame. A pinion gear is driven by the drive rack to drive the tray between an extended position underneath the ram of the press and a withdrawn position out of the press die area. The pinion gear is mounted in a rocking yoke to maintain pitch line contact between the drive rack and the pinion gear. The support frame includes opposed tray guides each guide including upper and lower spaced apart rails and the tray is mounted to the frame by front and rear sets of rollers, three rollers in each set, with the rollers positioned between the rails. The front set of three rollers has one roller contacting only the upper rail and the other two rollers contacting only the lower rail and the rear set of rollers has one roller contacting only the lower rail and two rollers contacting only the upper rail. The roller arrangement in the rails constrains the tray to linear movement along a plane parallel to the elongated axis of the rails and prevents vertical movement of the tray relative to the rails. The tray may include magnets to eliminate bouncing of workpieces released by the press.

4 Claims, 7 Drawing Figures

UNLOADER FOR PRESS

BACKGROUND OF THE INVENTION

This invention relates generally to attachments for conventional presses and, more specifically, to an unloader attachment which enters underneath a reciprocable ram to receive a workpiece as the workpiece is released from the press itself.

In the use of large presses in punching, blanking and stamping operations and the like, when a compound part is being prepared it is conventional for the compound part to remain attached to the die mounted on the reciprocable ram during the upstroke of the ram. At the top of the upstroke of the ram, a plurality of pins are contacted to release the workpiece. This is referred to as positive knock out of a workpiece and is conventional in this type of forming operation.

When the completely formed workpiece moves with the ram, once the workpiece has been released by a positive knock out, the workpiece falls under the influence of gravity and must be received by some type of unloading device. Prior to the present invention, a common technique was to have workmen reach in and grab the workpiece as it was being released from the ram.

The technology progressed to automated unloaders but these were not satisfactory for several reasons.

A first problem with prior art unloaders was the lack of synchronization of the movement of the unloader to the stroking of the press. The lack of synchronization typically resulted in contact between the unloader and the reciprocating ram, resulting in damage to the die mounted on the ram, to the unloader, and to the workpiece. A second problem was bouncing or vibrating of the unloader based upon the impact of the workpiece. This vibrating caused excessive wear to the unloader and often caused workpieces to bounce off of the unloader.

Hence the invention herein relates to an improved unloader for a conventional press which overcomes the foregoing problems. The present unloader is positively reciprocated by the press to maintain synchronization with the press stroke. The unloader includes a stationary support frame and a tray movably mounted on the support frame, and with the tray, as mounted, constrained for linear movement to eliminate bouncing and vibrating.

SUMMARY OF THE INVENTION

The present invention contemplates an unloader for a conventional press of the type having a reciprocable ram. The unloader includes a first drive rack positively reciprocated by the ram, a stationary support frame and a workpiece receiving tray movably mounted on the frame. Drive means including a second rack and a pinion gear assembly are driven by the first drive rack to move the tray between a first position extended into the die area and a withdrawn position removed from the die area. Since the first drive rack is positively reciprocated by the ram, the tray movement is timed to the press stroke of the ram and the tray enters the die area during the upstroke of the ram to receive the released workpiece and moves out of the die area during the downstroke of the ram to be clear of the ram at the time that the ram is contacting the next workpiece.

The present invention further includes a guide assembly to constrain the movement of the tray to linear movement and to prevent the tray from bouncing under the impact of a workpiece being released from the ram. Specifically, each side of the support frame includes upper and lower parallel elongated guide rails which are elongated in the direction of movement of the tray. The tray is mounted on first and second sets of rollers with the rollers positioned between the guide rails in a configuration to eliminate movement of the rollers transverse to the elongated axis of the guide rails.

Specifically, each set of rollers includes three rollers mounted on a single bracket and the first set of rollers is mounted so that two of the rollers contact only the lower guide rail and the third roller contacts only the upper guide rail. The second set of rollers is reversed, that is, one of the rollers contacts only the bottom guide rail and the other two rollers contact only the upper guide rail. This configuration of roller assembly eliminates bouncing or vibration of the tray when a workpiece is released and dropped onto the tray.

In addition, the present invention contemplates a rocking yoke for the pinion gear to maintain pitch line contact between the first drive rack, which is positively reciprocated by the ram, and the pinion gear. The rocking yoke assembly maintains the pitch line contact in the event of initial misalignment of the unloader and further after wear and tear on the parts.

The present invention further contemplates the inclusion of magnets on the tray to reduce bouncing of magnetizable workpieces as the workpieces are dropped from the ram.

BRIEF DESCRIPTION OF THE DRAWINGS

The foregoing objects and advantages of the present invention will become more apparent upon reading the following detailed description of the invention taken in conjunction with the drawings.

In the drawings, wherein like reference numerals identify corresponding parts of the present invention.

DETAILED DESCRIPTION OF THE INVENTION

The present invention is directed to an unloader adapted to be attached to a conventional press 10 of the type having a stationary bed 11, a reciprocable ram 12 and a die area 13 at which point the workpiece is formed by stamping, blanking or the like. As is conventional in this type of press, the reciprocating ram may have a female die member attached thereto and the stationary bed may have a male die member attached thereto. Also, as is conventional, the press may include a knock out assembly which is attached to the press so that on the upstroke of the ram, levers are contacted to pivot knock out pins to provide a positive knock out to release a workpiece from the reciprocable ram 12.

Figure 1:
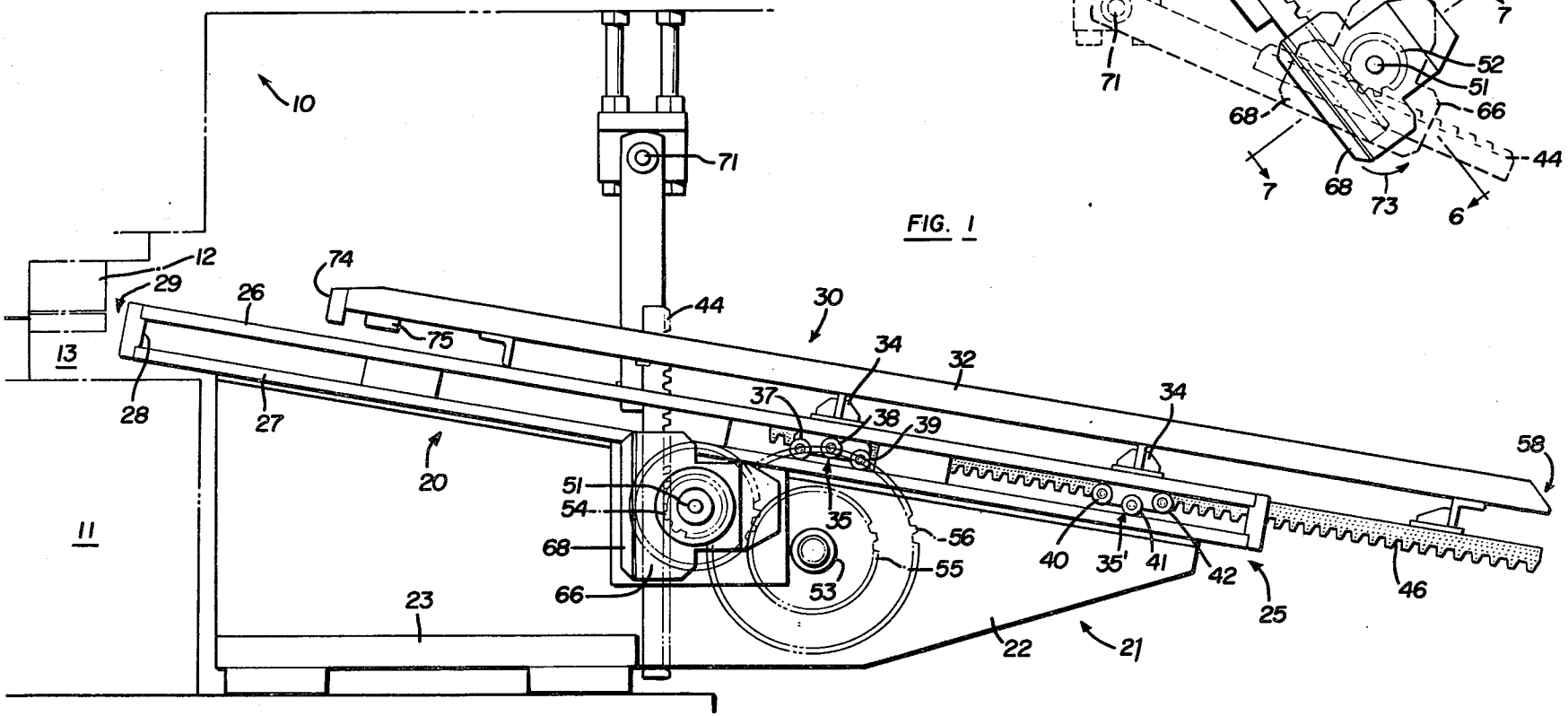
FIG. 1 is a side elevation view of the unloader of the present invention in a withdrawn position and with the reciprocable ram of the press at the conclusion of a downstroke.
Figure 2:
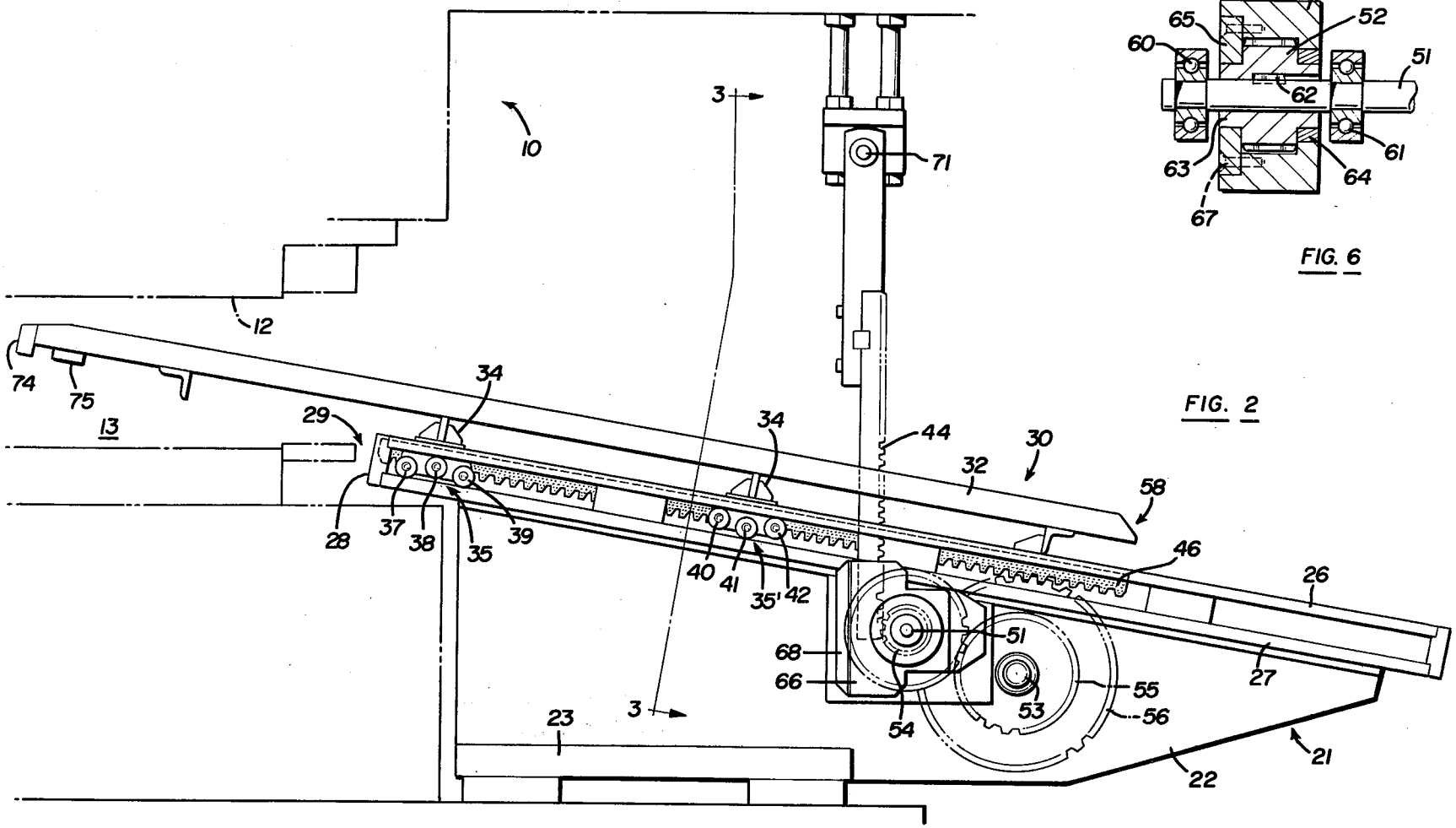
FIG. 2 is a side elevation view of the unloader of the present invention in an extended position into the die area and with the ram of the press in an upward position to release a workpiece onto the unloader of the present invention.

When a workpiece is released in the fashion just described, as can be understood from considering FIGS. 1 and 2, the workpiece would drop down onto the die area 13 in the absence of some mechanism for receiving the workpiece. Thus, in order to receive the workpiece, the present invention is directed to an unloader 20 which is timed to the press stroke to enter the die area 13 on the upstroke of the ram to receive the workpiece and to exit from the die area during the downstroke of the ram to avoid damage to the unloader, the ram and the workpiece.

Specifically, the unloader 20 of the present invention has a stationary support frame 21 which includes two vertical plate-like members 22 each of which has a horizontal flange 23 at the bottom thereof for attachment to the stationary bed 11 of the press. At the upper end of each vertical plate-like member 22 the stationary support frame includes guide means 25 which in the preferred embodiment are upper and lower spaced apart elongated rectangular tracks or rails 26,27 held together by end pieces 28. The stationary support frame has a front or distal end 29 which enters the die area 13 but is clear of the ram as illustrated generally at FIG. 1. The second end of the stationary support frame guide means 25 is exterior of the entire press.

In order to receive workpieces from the ram and to convey these workpieces out of the press area, a tray 30 is provided and this tray, which has a flat bottom 31 and upwardly extending vertical sides 32, is mounted for reciprocation relative to the guide rails 26,27. Thus the tray 30 is generally U-shaped in cross section with an elongated flat base 31 and short upwardly extending sides or legs 32. Mounted to the underside of the tray at the edges thereof are a plurality of side brackets 34 and front and rear roller assembly means 35,35' , respectively, are mounted on each of the brackets.

The front roller assembly 35 on each side of the tray includes three cams or rollers 37,38,39 all mounted on bracket 34 with the central roller 38 having its center slightly above the center of the outside rollers 37 and 39. Thus the centers of each of these three rollers define the corners of a triangle. The rollers are mounted between the rails and the end or front and rear rollers 37,39 contact only the lower guide rail 27 and the central roller 38 contacts only the upper guide rail 26.

The rear roller assembly 35' again includes three rollers 40,41,42 all mounted on the bracket 34 with the center of the end rollers 40 and 42 being above the center of the central roller 41. Thus the central roller 41 contacts only the lower guide rail 27 while the two end rollers 40,42 contact only the upper guide rail 26. Again, the centers of the three rollers define the corners of a triangle.

One of the objectives of the present invention is to synchronize the operation of the tray 30 with the press stroke. In order to accomplish this, the tray 30 is positively driven by the reciprocation of the ram 12 of the press. Extending downwardly from the ram 12 is a toothed rack 44 which drives a gear assembly 45. The gear assembly in turn drives another toothed rack 46 which is secured to the underside of the tray 30. Thus motion of the drive rack 44 by the reciprocating ram is translated through the gear assembly to movement of the rack 46 which is attached to the tray. Thus reciprocation of the ram causes synchronized reciprocation of the tray.

Figure 4:
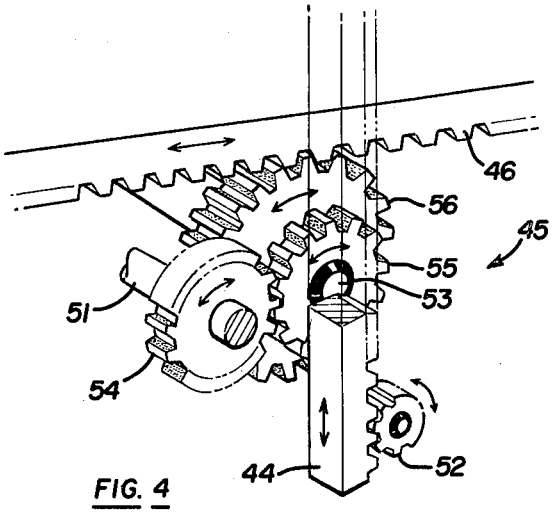
FIG. 4 is a diagrammatic illustration of the drive system of the present invention for reciprocating the unloader tray in response to reciprocation of the ram.

The gear assembly includes a first shaft 51 journalled in the vertical frame members 22 of the stationary support means. A first pinion gear 52 driven by rack 44 is mounted on the shaft 51. The press upon which the present invention has been utilized has a press stroke of ten inches and it has been found desirable that the tray moves 40 inches. Thus, a four to one gearing was deemed desirable and a second shaft 53 is provided behind the first shaft 51. A gear 54 on the first shaft 51 meshes with a gear 55 on the second shaft 52 to rotate the second shaft when the first shaft is rotated. A second pinion gear 56 is mounted on the second shaft to rotate with gear 55 and this pinion gear is in engagement with the rack 46 on the underside of the tray. Thus as illustrated schematically in FIG. 4, vertical movement of the drive rack 44 through the gear assembly causes rectilinear movement of the rack 46 and thus the tray 30.

Thus with respect to FIGS. 1 and 2 it may be appreciated that during the upstroke of the ram, the tray 30 is being moved inwardly until its distal end is underneath the ram as illustrated in FIG. 2. At this point the workpiece is released by a positive knock out and drops onto the tray itself. Since the tray is inclined relative to the horizontal, with the distal end raised, the workpiece slides downwardly along the tray towards the rear 58 of the tray at which point it may be manually removed or received by a conveyor system.

During the downstroke of the ram, the tray is withdrawn from the die area toward the position illustrated in FIG. 1 at which time another workpiece is formed by the press. At all times the distal end 29 of the stationary support frame 21 remains in the die area but clear of the ram. The tray movement is timed to the movement of the ram because the tray is driven by the movement of the ram itself.

As illustrated generally in FIG. 2, the tray 30 is mounted in the stationary support frame 21 by virtue of the side brackets 34 and roller assemblies 35,35'. When a workpiece is dropped on the distal end of the tray, it may be appreciated that there is a downward force at the front roller assemblies 35, that is, a downward force is experienced at the distal end 29 of the support frame which is in the die area. To absorb this downward force the roller assembly 35 has the two outer rollers in contact with the lower guide rail 27 and the central roller in contact with the upper guide rail 26. The two rollers in contact with the lower rail 27 prevent downward movement of the roller assembly 35 and the tray 30 relative to the guide rails at this point.

However, since this forms a fulcrum, the arrangement of rollers must be reversed at the rearward roller assemblies 35'. Thus the two outside rollers 40 and 42 must be in contact with the upper guide rail 26 while the central roller 41 is in contact with the lower guide rail. Again, the arrangement of the rollers constrains the tray to rectilinear movment relative to the elongated axis of the guide rails 26,27. Thus the tray does not bounce or vibrate upon impact from a workpiece but instead reciprocates in a plane parallel to the elongated axis of the guide rails. This is referred to as pre-loading the tray on the rails 26,27.

Furthermore, in order to make the size of these rollers manageable and still absorb sufficient shock, i.e. reduce the lever arm at the fulcrum, it is preferred to extend the front of the support inwardly as far as possible into the die area 13 as illustrated in FIGS. 1 and 2. Thus the distance between the distal end of the support and the distal end of the tray should be as short as possible.

As may be appreciated from FIGS. 1 and 2, should the unloader 20 not be vertically aligned relative to the press 10, then the drive rack 44 might not reciprocate in a purely vertical plane. Should this occur, there would be, conventionally, a loss of pitch line contact between the pinion gear 52 and the drive rack 44.

To avoid such a problem, the present invention also includes a rocking yoke assembly to maintain the pitch line contact between the drive rack and the pinion gear both during initial misalignment and due to wear and tear on the parts.

Figure 5:
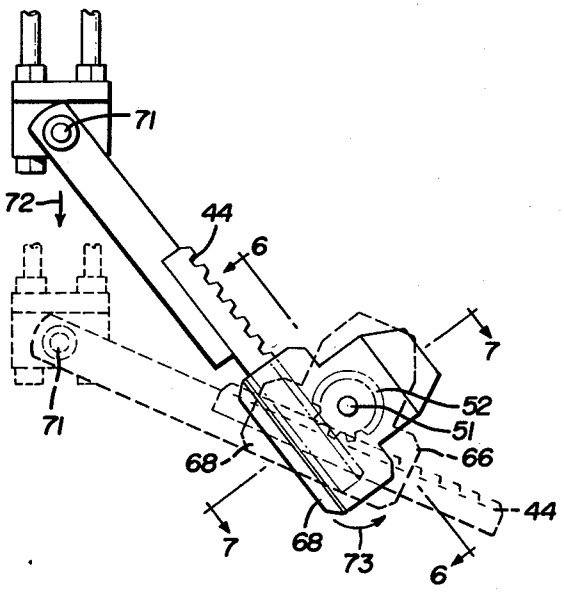
FIG. 5 is a diagrammatic side elevation illustration of the rocking yoke assembly of the present invention utilized to maintain pitch line contact between the drive rack and the pinion gear as the drive rack moves downwardly.
Figure 6:
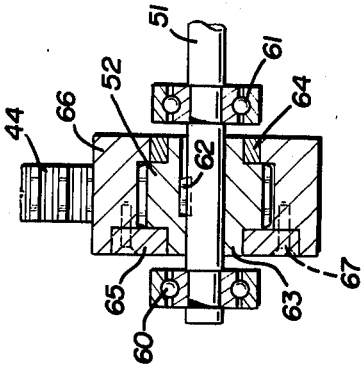
FIG. 6 is a cross sectional plan view of the rocking yoke assembly of the present invention as seen in the plane of arrows 6—6 of FIG. 5.
Figure 7:
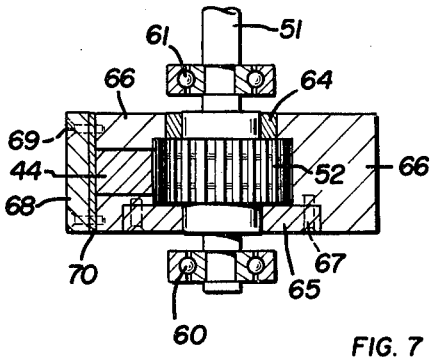
FIG. 7 is a cross-sectional side view of the rocking yoke assembly as seen in the plane of arrows 7—7 of FIG. 5.
Figure 3:
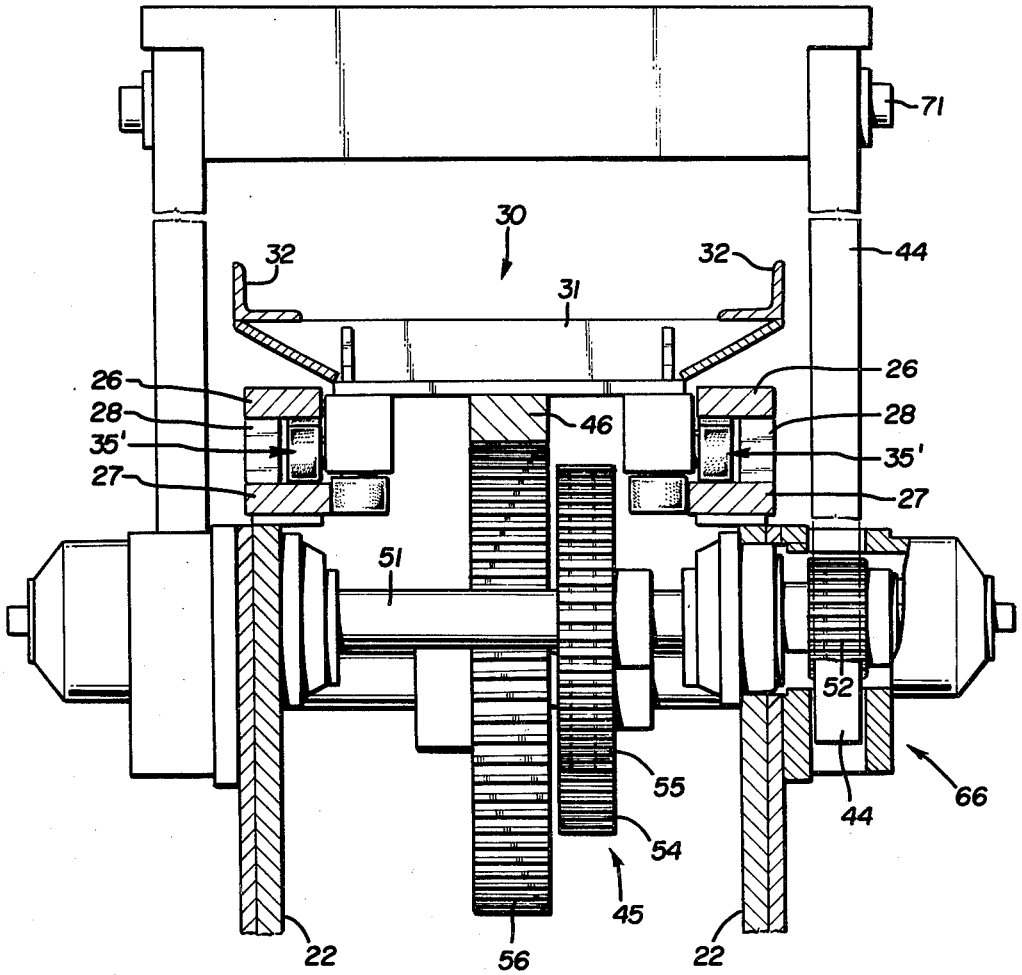
FIG. 3 is a cross sectional front elevation view of the unloader of the present invention as seen in the plane of arrows 3—3 of FIG. 2.

As seen in greater detail in FIGS. 5, 6 and 7, the drive shaft 51, which is journalled through the vertical plate 22 of the frame, rotates in conventional bearings 60,61. The pinion gear 52 is secured to the shaft 51 by a key 62 and the pinion gear has a hub 63 on each side thereof. A bearing 64 surrounds the hub on one side of the gear and a second bearing 65 surrounds the hub on the other side of the gear. A yoke 66 having a generally U-shaped configuration is mounted for rotation on and supported by the bearings 64,65 to thus rotate around the pinion gear 52. Bearing 65 is attached to the yoke by bolts 67 and functions as a retainer bearing to permit assembly and disassembly of the rocking yoke assembly. The drive rack 44 is positioned in the space between the legs of the yoke, in engagement with the pinion gear, and a cover plate 68 is bolted to the yoke legs as at 69. The cover plate contacts the rear of the drive rack 44. In order to maintain pitch line contact between the rack 44 and the pinion gear 52 it may be necessary to place a shim 70 of the multiple lamination type between the legs of the yoke and the cover. Then, during reciprocation of the drive rack 44, the drive rack rocks or rotates the yoke to maintain pitch line contact between the drive rack and the pinion gear by actually changing the tangent point between the rack and gear.

More specifically, the drive rack 44 is pivotally mounted to the press as at 71. Pivot 71 moves only vertically on the press stroke as at arrow 72. However, the rack follows a non-linear path from the solid line position in FIG. 5 to the dash line position in FIG. 5. That is, the end of the rack connected to the pivot 71 moves vertically but the rack itself move angularly or non-linearly as shown in FIG. 5. Since the yoke rotates relative to the gear, the movement of the rack forces the yoke to rotate slightly as shown by arrow 73. The rotation of the yoke compensates for the non-linear movement of the rack by permitting the tangent point between the rack and the gear to shift around the circumference of the gear 52.

In summary, the present invention is directed to an unloader for a press which is driven positively by the press to maintain timing between the press stroke and the tray movement. The tray support extends into the die area to provide additional support for the tray and the tray is mounted on rollers within guide rails to constrain the tray to rectilinear movement. This is called preloading of the tray on the roller and this preloading absorbs any bouncing occasioned by the impacting of a dropped workpiece onto the tray. A rocking yoke assembly is provided to accommodate wear and tear of the drive mechanism and also to accommodate misalignment of the drive mechanism. In addition, although the present invention may be utilized for both metal stampings and stampings of non-metallic material including plastics, the distal end of the tray 74 may be provided with a plurality of magnets 75 on its underside to attract metal workpieces of magnetizable material to avoid the workpiece bouncing as it contacts the tray. This workpiece bouncing, of course, is different from the bouncing of the tray which is eliminated by the preloader roller assembly previously described.

In order to evaluate the unloader of the present invention, an unloader was built and tested on a 1,000-ton press having a 144 inch by 108 inch bed size and operating in the range of 15–45 strokes per minute. During two test runs, the tray operated through 56,000 cycles (112,000 reversals of direction) without any failure, without any indication of unreliability and without any indication of excessive wear.

I claim:

1. In an unloader to be attached to a press or the like, the press including a reciprocable ram having a lower position for forming workpieces in a die area and having an upper position where said formed pieces are released or dropped such as by a positive knock out or the like, said ram being driven between said upper and lower positions as is conventional, and an automatic workpiece unloader to be driven by the movement of the ram including a drive rack to be attached to said reciprocable ram for positive synchronized reciprocation therewith;

a stationary support frame having a distal end extending into said die area, said frame at all times being free from contact with said ram;

a tray movably mounted on said stationary support frame, said tray having an extended position with the distal end of the tray beyond the distal end of the frame into the die area and beneath the ram when the ram is in its upper position, said tray having a withdrawn position out of the die area; and drive means driven by said drive rack for reciprocating said tray between its extended position and its withdrawn position upon reciprocation of said ram between its upper position and its lower position, respectively;

so that during movement of the ram toward its upper position, the tray is moved toward its extended position under the ram to receive a falling workpiece as the workpiece is released by the press and during movement of the ram toward its lower position the tray is moved toward its withdrawn position clear of the moving ram, the improvement comprising:

one pair of spaced apart rails on each side of said stationary support frame, each pair including an upper rail and a lower rail defining a single track therebetween; roller means positioned in each single track; said tray mounted on said roller means; and said roller means includes first and second sets of three rollers each, said first set of rollers including two rollers contacting only the lower rail and the third roller contacting only the upper rail and said second set of rollers having two rollers contacting only said upper rail and the third roller contacting only said lower rail, said rollers contacting the rails for constraining the tray to linear movement parallel to the longitudinal axis of said rails, and to prevent bouncing of the tray when workpieces are dropped on the tray.

2. The invention as defined in claim 1, wherein said drive means includes a toothed rack mounted to said tray, a first shaft journalled in said frame and having a first pinion gear mounted thereon and a yoke pivotally mounted on said first pinion gear, said yoke for maintaining pitch line contact between said drive rack and said first pinion gear, and further including a second pinion gear coupled to said first pinion gear for engaging said toothed rack on said tray to drive said tray when said drive rack drives said first pinion gear.

3. The invention as defined in claim 1, wherein said drive means includes a toothed rack mounted on said tray and a gear cluster including a first pinion gear engaged by and driven by said drive rack and a second pinion gear to engage the toothed rack on said tray to drive said tray, said first pinion gear and said second pinion gear being coupled together.

4. The invention as defined in claim 3, wherein said drive means further includes a first shaft journalled in said frame with said first pinion gear mounted on said first shaft and further including a yoke rotatably mounted relative to said first pinion gear to maintain the pitch line contact between said drive rack and said first pinion gear even when said drive rack is reciprocated along an arcuate path.

* * * * *